US005749102A

United States Patent [19]

Duell

[11] Patent Number: 5,749,102

[45] Date of Patent: May 12, 1998

[54] IN-LINE SEWAGE PUMP

[76] Inventor: Samuel I. Duell, 7524 Brookshire Dr., Prince George, Va. 23875-3145

[21] Appl. No.: 792,444

[22] Filed: Jan. 31, 1997

[51] Int. Cl.[6] ..... E03D 11/00

[52] U.S. Cl. ..... 4/431; 4/321; 417/1

[58] Field of Search ..... 4/321, 431; 417/1; 415/88

[56] References Cited

U.S. PATENT DOCUMENTS 3,161,135 12/1964 Eriksson ..... 417/1

4,246,665 1/1981 Albertassi et al. ..... 4/321

5,036,554 8/1991 Blount ..... 4/431

*Primary Examiner*—Robert M. Fetsuga

*Attorney, Agent, or Firm*—Norman B. Rainer

[57] ABSTRACT

An automatically activated pump for advancing mixed fluid waste from a toilet for disposal at an elevation above the toilet utilizes a flow sensing blade disposed within an intake conduit. The blade is joined to an activation finger located outside the conduit. The blade is adapted to undergo pivoted motion under the influence of a flow of fluid waste caused by the flushing of the toilet. The pivoted motion causes the finger to contact an electrical switch which activates the pump.

5 Claims, 1 Drawing Sheet

IN-LINE SEWAGE PUMP

BACKGROUND OF THE INVENTION

1. Field of the Invention

This invention relates to apparatus for propelling a fluid stream through a conduit, and more particularly concerns an automatically activated pump for advancing mixed fluid waste through a sewage pipe en route to disposal.

2. Description of the Prior Art

Numerous designs of fluid-handling pumps are known, some of which are specifically designed for use on liquid streams having suspended solid matter.

In the usual operation of a toilet, flushing is achieved by the rapid addition of water to the bowl of the toilet, an action which causes the contents of the bowl to flow over a retaining wall and thence downwardly by gravity effect into a sewage-conveying pipe. In those specialized circumstances where the toilet is located below the sewage-conveying pipe, pumping methods must be used to supplant the missing gravity effect.

It is clearly desirable to achieve the flushing in a single operation, as opposed to two separate and synchronized steps such as operating a valve to admit water to the bowl and a switch to activate a pump.

It is accordingly an object of the present invention to provide pumping apparatus for use in augmenting the flushing of a toilet which is located below its associated sewage-conveying pipe.

It is a further object of this invention to provide apparatus as in the foregoing object which functions automatically in response to inflow of water into the bowl of the toilet during the flushing operation.

It is another object of the present invention to provide apparatus of the aforesaid nature which is not readily subject to malfunction and is easily serviceable.

It is a still further object of this invention to provide apparatus of the aforesaid nature which is of simple, durable construction amenable to low cost manufacture.

These objects and other objects and advantages of the invention will be apparent from the following description.

SUMMARY OF THE INVENTION

The above and other beneficial objects and advantages are accomplished in accordance with the present invention by a pumping apparatus for use in association with a toilet having a bowl and means for the rapid addition of water to said bowl to initiate a flushing action which flows toward a sewage-conveying pipe located above said toilet, said apparatus comprising:

a) a horizontally disposed intake conduit having interior and exterior surfaces, upper and lower regions, an upstream extremity that communicates with said bowl, and an open downstream extremity, b) flow sensing means positioned within said intake conduit and adapted to be restorably displaced in the direction of said downstream extremity in response to the flow of water through said intake conduit, c) pivot means associated with said intake conduit for supporting said flow sensing means, d) an activation finger disposed exteriorly of said intake conduit in rigid association with said flow sensing means and moveable toward the exterior surface of said conduit in response to displacement of said flow sensing means in the direction of said downstream extremity, e) electrical switch means disposed upon the exterior surface of the upper region of said intake conduit and positioned in a manner to be contacted by said activation finger, f) a pump housing communicating with the downstream extremity of said intake conduit, g) a multi-bladed impeller positioned within said housing and rotatable upon an axle positioned at an elevation adjacent the upper region of said intake conduit, said blades having distal extremities which are of resilient construction and angled rearwardly with respect to the direction of rotation of said impeller, h) a discharge conduit having an entrance extremity that communicates with said housing, and an open exit extremity that leads toward said sewage-conveying pipe, i) an electric motor that drives said impeller when activated by said switch, and j) an access panel removably associated with said housing.

In preferred embodiments, the intake and discharge conduits are of circular cylindrical shape, and the flow sensing means is a blade that occupies 10% to 30% of the cross-sectional area of the intake conduit and is disposed orthogonally to the axis of elongation of said conduit.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
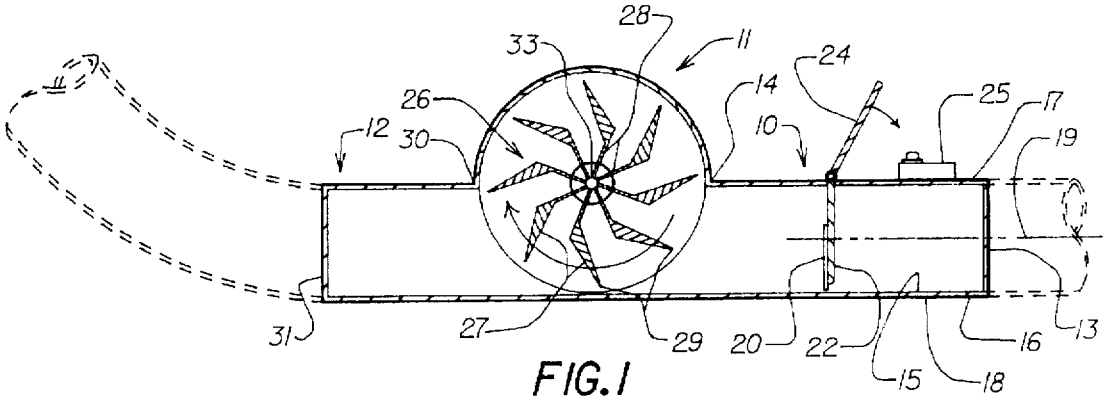
FIG. 1 is a sectional side view of an embodiment of the pumping apparatus of this invention.
Figure 2:
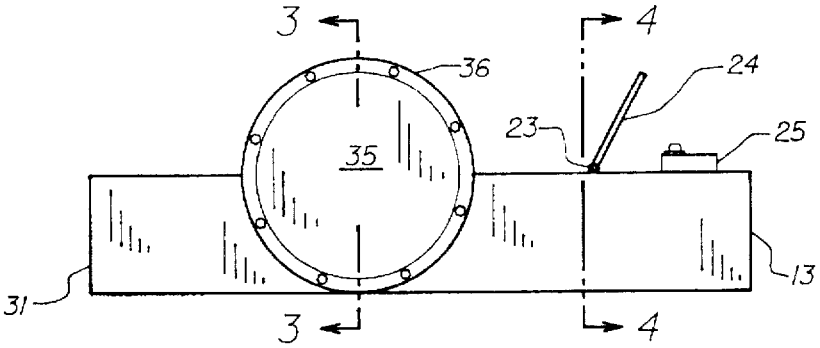
FIG. 2 is an exterior side view of the embodiment of FIG. 1.
Figure 4:
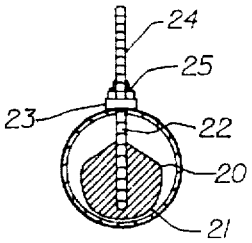
FIG. 4 is a sectional view taken in the direction of the arrows upon the line 4—4 of FIG. 2.
Figure 3:
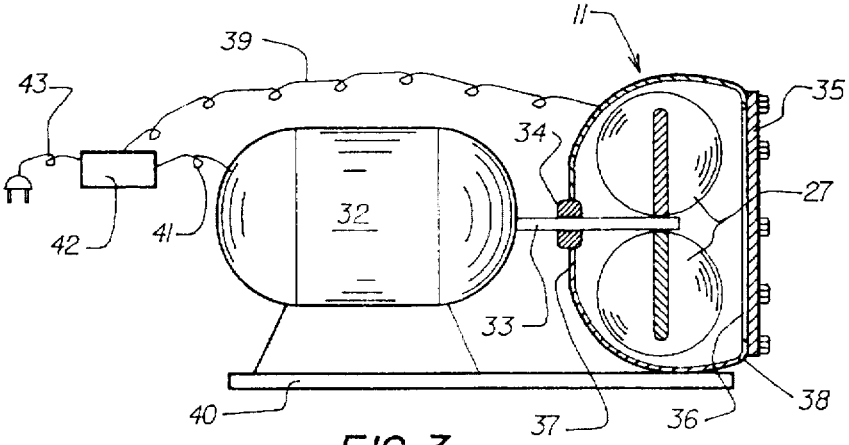
FIG. 3 is a sectional view taken in the direction of the arrows upon the line 3—3 of FIG. 2.

Referring now to FIGS. 1–4, an embodiment of the pumping apparatus of the present invention is shown comprised of intake conduit 10, pump housing 11 and discharge conduit 12 fabricated as a single integral unit molded of a non-corrodable material such as polyvinylchloride plastic.

Intake conduit 10, shown to be of circular cylindrical shape, is horizontally disposed, extending between an upstream extremity 13 that communicates with the bowl of a toilet, and an open downstream extremity 14. Conduit 10 may be further characterized in having interior and exterior surfaces 15 and 16, respectively, upper and lower regions 17 and 18, respectively, and center axis of elongation 19. In alternative embodiments, intake conduit 10 may be of rectangular shape.

Flow sensing means in the form of blade 20 is positioned within said intake conduit in substantially orthogonal relationship to axis 19. Blade 20 is shown to have an arcuate edge 21 that closely approaches interior surface 15. The exemplified embodiment of blade 20 occupies about 30% of the interior cross-sectional area of conduit 10, and is secured to support rod 22 which extends to the upper region of conduit 10 where it engages pivot means 23.

The manner of construction of said flow sensing means is such that blade 20 hangs vertically when there is no flow in conduit 10, but undergoes pivoted displacement in an arc of travel toward downstream extremity 14 when water flows from said toilet through conduit 10. Said arc of travel is indicated by the arcuate arrowed line in FIG. 1. The extent of said displacement is between about 40 and 70 degrees of circular arc about pivot means 23. It has been found that, when blade 20 occupies less than about 10% of the cross-sectional area of conduit 10, displacement by said water flow becomes unreliable, and when said blade occupies more than about 30% of the area of conduit 10, it significantly impedes said flow.

An activation finger 24 extends upwardly from support rod 22, preferably as a continuous integral extension of said rod. Finger 24 is accordingly moveable toward exterior surface 16 of conduit 10 in an arc of travel about pivot means 23. Such movement occurs when blade 20 is driven toward downstream extremity 14 by a flow of water. Finger 24 is preferably directed toward upstream extremity 13 in angled relationship to rod 22. Pivot means 23 preferably employs magnetic coupling means which permit the coupling of activation finger 24 with support rod 22 without penetrating conduit 10. Other constructions of said pivot means involving, for example, O-ring sealants, slidingly interactive gaskets or a diaphragm cover may also be employed.

Electrical pressure-activated switch means 25 is disposed upon the exterior surface of the upper region of intake conduit 10. Said switch means is positioned in a manner to be contacted by said activation finger in its closest approach toward conduit 10.

A multi-bladed impeller 26 is positioned within housing 11. The blades 27 of the impeller have radial portions 28 and distal extremities 29 which are constructed of a resilient material such as rubber. Said distal extremities are angled with respect to said radial portions, causing said distal extremities to be displaced rearwardly with respect to the direction of rotation of said impeller, said direction indicated by the arrowed line in FIG. 1. The overall outer perimeter of the blades is preferably circular.

Discharge conduit 12 has an entrance extremity 30 that communicates with said housing, and an open exit extremity 31 that leads toward said sewage-conveying pipe.

An electric motor 32 is provided having drive shaft 33 that constitutes the axle of said impeller, and is imperviously journaled through the rear face 37 of housing 11 by way of bushing 34. Shaft 33 is horizontally oriented, and enters housing 11 at an elevation adjacent upper region 17 of intake conduit 10. Motor 32 is electrically connected by conductor wire 41 to relay box 42 which receives electric current through conductor 43. Said relay box is joined by conductor wire 39 to switch means 25. When switch means 25 is contacted by finger 24, relay box 42 routes electric current to motor 32, causing impeller 26 to be rotated in the direction indicated by the arcuate arrowed line in FIG. 1. Motor 32 is preferably of variable speed type, having sufficiency power to cope with transient overloads and variable hydraulic heads.

An access panel 35 removably covers a servicing aperture 36 of corresponding size in the front face 38 of housing 11. The size of aperture 36 is sufficiently large to permit replacement of impeller 26.

Motor 32 and housing 11 are preferably mounted upon a base plate 40. All materials of construction are selected so as to be corrosion-resistant. Accordingly, plastics such as polyvinylchloride are preferred materials of construction.

By virtue of the aforesaid specialized components and the nature of their interaction, the contents of a toilet can be discharged to a sewer line at higher elevation, and such discharge is accomplished by way of the single usual manipulation of the flushing means associated with the toilet. In preferred embodiments, a check valve may be employed downstream from exit extremity 31 for the purpose of preventing back flow toward the pumping apparatus of this invention. In installations wherein the pumping apparatus is underground, it is preferably disposed within a protective enclosure which is provided with gasketed apertures to accommodate intake and discharge conduits 10 and 12, respectively.

While particular examples of the present invention have been shown and described, it is apparent that changes and modifications may be made therein without departing from the invention in its broadest aspects. The aim of the appended claims, therefore is to cover all such changes and modifications as fall within the true spirit and scope of the invention.

Having thus disclosed my invention, what is claimed is:

1. A pumping apparatus for use in association with a toilet having a bowl and means for the rapid addition of water to said bowel to initiate a flushing action which flows toward a sewage-conveying pipe located above said toilet, said apparatus comprising:

a) a horizontally disposed intake conduit having interior and exterior surfaces, upper and lower regions, an upstream extremity that communicates with said bowl, an open downstream extremity, and a center axis of elongation.

b) flow sensing means positioned within said intake conduit and adapted to be restorably displaced in the direction of said downstream extremity in response to the flow of water through said intake conduit, c) pivot means associated with said intake conduit for supporting said flow sensing means, d) an activation finger disposed exteriorly of said intake conduit in rigid association with said flow sensing means and moveable toward the exterior surface of said conduit in response to displacement of said flow sensing means in the direction of said downstream extremity.

e) electrical switch means disposed upon the exterior surface of the upper region of said intake conduit and positioned in a manner to be contacted by said activation finger, f) a pump housing communicating with the downstream extremity of said intake conduit, said housing having front and rear faces, said front face having a servicing aperture covered by a removable access panel, g) a multi-bladed impeller positioned within said housing and rotatable upon an axle positioned at an elevation adjacent the upper region of said intake conduit, said blades having distal extremities which are of resilient construction and angled rearwardly with respect to the direction of rotation of said impeller, h) a discharge conduit having an entrance extremity that communicates with said housing, and an open exit extremity that leads toward said sewage-conveying pipe, i) an electric motor that drives said impeller when activated by said switch, and j) an access panel removably associated with said housing.

2. The apparatus of claim 1 wherein said intake and discharge conduits are of circular cylindrical shape.

3. The apparatus of claim 1 wherein said flow sensing means is a blade that occupies between 10% and 30% of the cross-sectional area of said intake conduit.

4. The apparatus of claim 3 wherein said blade is orthogonally disposed to said axis of elongation.

5. The apparatus of claim 1 wherein said servicing aperture is sufficiently large to permit removal of said impeller from said housing.

* * * * *